United States Patent [19]

Kidd et al.

[11] 3,943,477

[45] Mar. 9, 1976

[54] ELECTRICAL CIRCUIT BREAKERS

[75] Inventors: Alan Lister Kidd, Southport; Douglas Eaves, Blackpool; Keith Walmsley, Preston, all of England

[73] Assignee: Dorman Smith Switchgear Limited, Preston, England

[22] Filed: Sept. 12, 1974

[21] Appl. No.: 505,223

[30] Foreign Application Priority Data

Oct. 4, 1973 United Kingdom ..... 46291/73

[52] U.S. Cl. ..... 337/57; 74/553; 200/336; 335/45; 337/82

[51] Int. Cl.[2] ..... H01H 71/16

[58] Field of Search ..... 337/6, 7, 45, 57, 82, 93, 337/94, 99; 335/42, 45, 176; 74/553; 200/336

[56] References Cited

UNITED STATES PATENTS

| | | | |
|---|---|---|---|
| 3,084,236 | 4/1963 | Klein et al. | 335/10 |
| 3,142,187 | 7/1964 | Kane et al. | 74/553 |
| 3,211,861 | 10/1965 | Freese | 337/82 |
| 3,226,510 | 12/1965 | Thomas et al. | 337/57 |
| 3,708,771 | 1/1973 | Schreckenberg et al. | 337/82 |
| 3,775,713 | 11/1973 | Walker et al. | 335/176 |

*Primary Examiner*—Harold Broome
*Attorney, Agent, or Firm*—Ross, Ross & Flavin

[57] ABSTRACT

An electrical circuit breaker having a thermal element which on being heated by fault current trips the breaker, and including an adjustable member to vary the action of the thermal element thereby to vary the rating of the breaker, said adjustable member comprising a slide displaceable by an eccentric boss rotatable by means of an external knob.

6 Claims, 12 Drawing Figures

ELECTRICAL CIRCUIT BREAKERS

This invention concerns electrical circuit breakers of the kind which includes a thermal element which becomes heated upon passage of a current through the circuit breaker and which, upon occurrence of sustained overload (i.e. sustained passage of current in excess of the rated capacity of the breaker) initiates the tripping operation of the circuit breaker.

An object of the invention is to provide a simple arrangement providing for variation of the position of an adjusting member associated with the thermal element to enable the action of the latter to be varied and thereby vary the rating of the circuit breaker.

With this object in view the present invention provides an electrical circuit breaker of the kind referred to characterised by the provision of an adjusting member associated with the thermal element and displaceable relative to such thermal element to vary the action of the latter thereby to vary the rating of the circuit breaker, and in that the adjusting member includes a slide displaceable linearly by an eccentric boss rotatable manually by means of a knob accessible externally of the circuit breaker.

Conveniently the knob is formed with a recess in which the boss is secured.

Preferably the securement of the boss to the knob is adjustable to provide for the eccentricity of the boss to be varied thereby to vary the extent of the adjustment which is achieved by rotating the knob.

Relative hereto, the boss and the knob are conveniently formed the one with a groove and the other with a complementary rib engaging into the groove, said rib and groove extending diametrically relative to the axis of rotation of the knob and providing for corresponding diametrical adjustment of the boss.

In a preferred embodiment, the slide is engaged with the boss by the latter being located between confronting bearing surfaces at opposite sides of a recess in the slide.

In order that the invention may be fully understood, it will be described further, by way of example, with reference to the accompanying drawings, in which.

Figure 3:
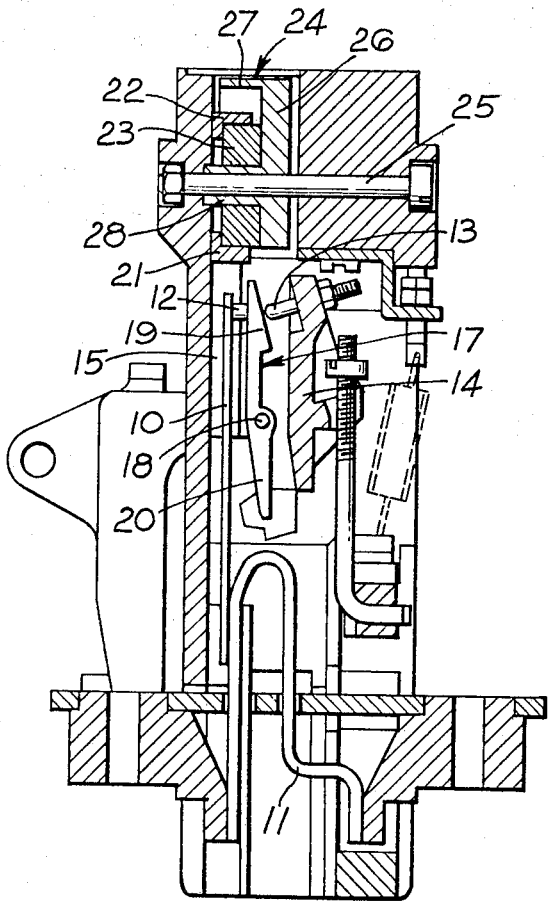
FIG. 3 is a section through the tripping mechanism in correspondence with any one of the poles of the circuit breaker as indicated by the three section lines III—III of FIG. 1.

The tripping mechanism, illustrated in the drawings, of a three-pole circuit breaker conforming to the invention comprises, for each pole (which poles are indicated generally at A, B and C respectively) a thermal element in the form of a bimetal strip 10 secured in heat-conducting contact to a respective conductor 11 by which current passes through the corresponding pole of the circuit breaker. Each such bimetal strip 10 has a respective nose or protuberance 12 projecting towards a respective contact point, provided by a respective calibration screw 13, on a trip bar 14. The trip bar 14 extends across and is common to the three poles A, B and C, and is mounted so as to be pivotable about an axis extending longitudinally thereof, the arrangement being such that clockwise pivoting of the trip bar 14 from the position shown in FIG. 3 results in tripping of the circuit breaker.

Accordingly, the consttuction of the trip mechanism is such that upon the passage of a sustained overload through one of the poles A, B or C of the circuit breaker, the corresponding conductor 11 becomes heated and transmits heat to the bimetal strip which, in due time, becomes deflected towards the trip bar 14 to cause the above-described pivoting movement of the latter and tripping of the circuit breaker.

As so far described the operation of the tripping mechanism is substantially similar to prior known constructions. The illustrated embodiment differs from such known constructions, however, in that it comprises means (a) enabling the action of the thermal element constituted by the bimetal strip 10 to be varied and, additionally, (b) enabling the possible extent of such variation to be adjusted.

Figure 2:
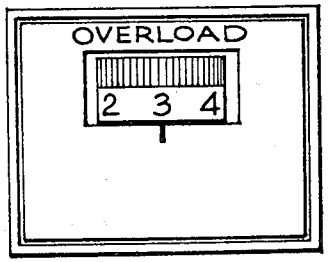
FIG. 2 is a view taken as indicated by arrow II of FIG. 1, illustrating manually-operable adjustment means forming part of the mechanism of FIG. 1.
Figure 1:
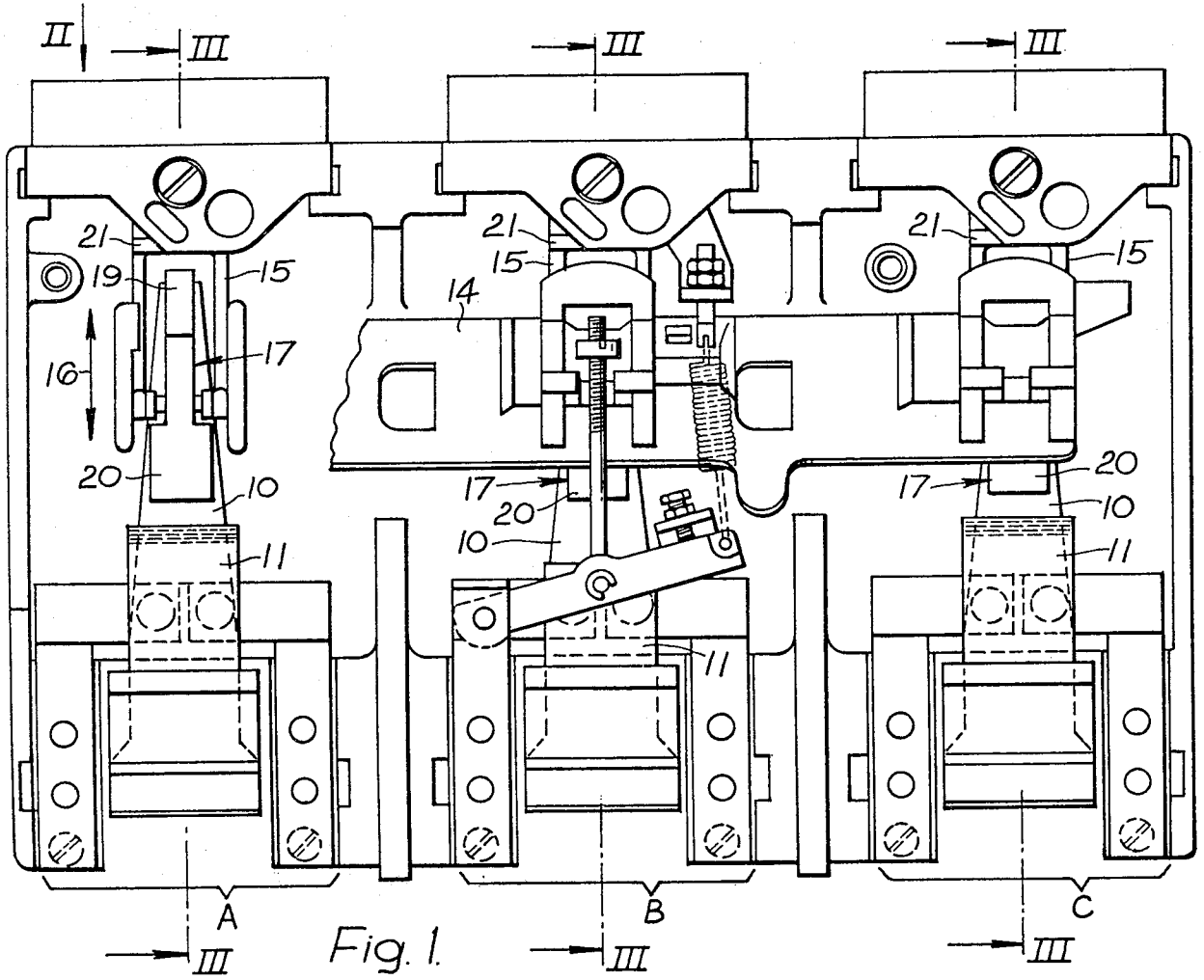
FIG. 1 is an elevation, with certain parts omitted or broken away for clarity, of the tripping mechanism of a three-pole circuit breaker constructed in accordance with the present invention.

Pursuant thereto, each such pole A, B and C comprises a respective slide 15 which is displaceable in a plane parallel to the respective bimetal strip 10 as indicated by the double arrow 16 in FIG. 1 and whereon a wedge member 17 is pivotally mounted by way of a pivot pin 18. This wedge member 17 has a wedge-shaped head 19 which projects between the respective nose or protuberance 12 and the corresponding calibration screw 13, and accordingly it will be understood that the amount by which the bimetal strip 10 needs to deflect to cause tripping movement of the trip bar 14 (and therefore the action of the bimetal strip 10) varies according to the effective thickness of the head 19 present between the protuberance 12 and the screw 13 as determined by the position of the slide 15.

To minimise the possibility of the wedge member 17 being affected by vibrations or shock, it comprises also a counterweight 20 which substantially balances the head 19.

The slide 15 is formed, at its end away from the wedge member 17, with a pair of transverse thrust ribs 21, 22 (see particularly FIG. 3) and located between these two ribs 21, 22 is a respective adjusting boss 23 secured eccentrically in a recess in a knob 24 which is pivotally mounted on a fixed pivot bolt 25 and is accessible from outside the casing of the circuit breaker. It will thus be appreciated that rotation of the knob 24, by reason of the eccentricity of the boss 23, is translated into corresponding linear displacement of the slide 15 substantially parallel to the bimetal strip 10 as indicated by the arrow 16.

Figure 7:
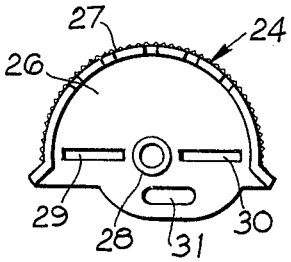
FIG. 7 is an elevation of the knob.
Figure 9:
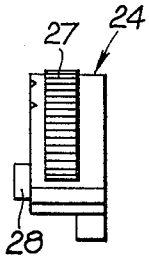
FIG. 9 is a side view of the knob.
Figure 8:
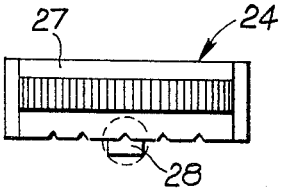
FIG. 8 is a plan view of the knob.

The knob 24 is illustrated in detail in FIGS. 7, 8 and 9 from which it will be seen that it comprises an approximately semi-circular back plate 26 having therearound a flange 27 which defines the recess in which the boss 23 is accommodated. An integral bush 28 is provided for the pivot bolt 25 to extend therethrough and extending diametrically at opposite sides of such bush 28 are shallow grooves 29 and 30. Parallel to these grooves 29 and 30 is a slot 31.

Figure 10:
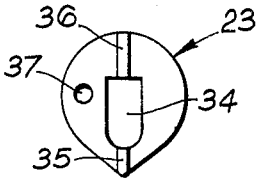
FIG. 10 is a front elevation of the boss.
Figure 11:
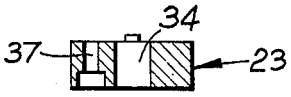
FIG. 11 is a cross-sectional view of the boss.
Figure 12:
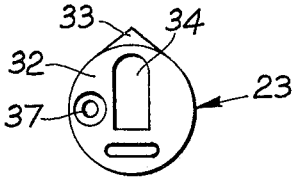
FIG. 12 is a rear elevation of the boss.

The boss 23 is shown in detail in FIGS. 10, 11 and 12. As can be seen it is approximately pear-shaped in configuration, being composed of a basic circular disc 32 formed with an approximately triangular lobe 33, of thickness somewhat thinner than the disc 32, at one point on its periphery, so that the configuration of the boss 23 is symmetrical about an axis of symmetry extending substantially diametrically of the disc 32 and through the tip of the lobe 33. A slot 34 is provided through the boss 23 for slidably locating the boss 23 over the bush 28, this slot 34 being directed along the axis of symmetry, and also formed on said axis are two locating ribs 35 and 36 which are complementary to and engageable in the grooves 29 and 30 in the back plate 26 of the knob 24. A counter bored hole 37 is provided through the boss 23 adjacent the slot 34 for permitting the boss 23 to be fixed to the knob, as shown in FIGS. 4, 5 and 6, with the ribs 35, 36 engaged in the grooves 29, 30 and the bush 28 accommodated in the slot 34, by a bolt 38 through the hole 37 and the slot 31 in the knob 24.

Figure 4:
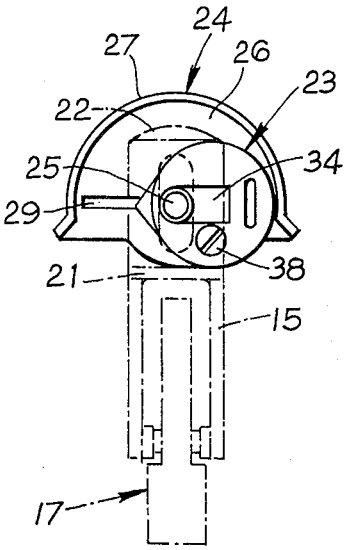
FIG. 4 is a detached detail illustrating the eccentric boss and knob of the adjusting means of the arrangement illustrated in FIGS. 1 to 3, these parts being shown in a mean position in which the boss can be adjusted relative to the knob without affecting the other components of the mechanism.
Figure 5:
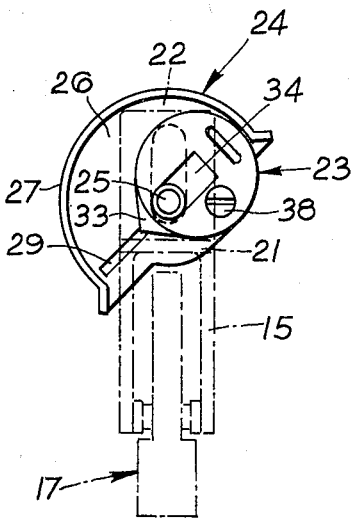
FIG. 5 is a view similar to FIG. 4 but showing the knob and boss having been adjusted to provide a minimum rating for the breaker.
Figure 6:
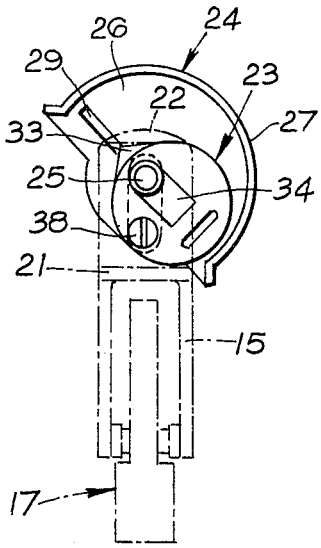
FIG. 6 is a view similar to FIGS. 4 and 5, but showing the knob and boss having been adjusted to provide a maximum rating for the breaker.

FIGS. 4, 5 and 6 show the boss 23 secured to the knob 24 in its position of maximum eccentricity so that rotation of the knob 24 to the end position, shown in FIG. 5, in which the lobe 33 abuts the thrust rib 21, shifts the wedge member 17 to its position with the thickest portion of the head 19 between the nose 12 and the calibration screw 13, thereby adjusting the corresponding circuit breaker's pole to its lowest possible rating. Conversely, rotation of the knob 24 to the end position of FIG. 6 in which the lobe 33 abuts the thrust rib 22, shifts the wedge member 17 to its position with the thrust portion of the head 19 between the nose 12 and the calibration screw 13, thereby adjusting the corresponding circuit breaker's pole to its highest possible rating. In the illustrated embodiment, with the boss 23 at maximum eccentricity as shown, rotation of the knob 24 provides for a variation of plus or minus about 20 percent from the designed rating which is obtained in the median position of the knob 24 as shown in FIG. 4 in which the axis of symmetry of the boss 23 is substantially perpendicular to the direction of movement of the slide 15.

The magnitude of the possible variation of the rating achieved by rotation of the knob 24 can be adjusted by adjusting the eccentricity of the boss 23. This is done with the knob 24 in its median position of FIG. 4 of the drawings and is effected by slackening the bolt 38, shifting the boss 23, as required, along its line of symmetry and at right angles to the direction of movement 16 of the slide 15 and retightening the bolt 38. Since the boss 23 is adjusted parallel to the thrust ribs 21 and 22, the adjustment does not cause an alteration of the position of the slide 15 and wedge member 17 and the median position and rating of the circuit breaker remains unaffected.

The invention is not confined to the precise details of the foregoing example, and variations may be made thereto. Thus, although in the described embodiment the slide 15 carries a wedge member 17 whose displacement serves to alter the action of the bimetal strip 10 other arrangements are possible. Thus, for instance the slide could be arranged to displace the bimetal strip 10 bodily towards or away from the trip bar 14 or its corresponding calibration screw to alter the action of the bimetal strip and vary the effective rating of the circuit breaker. Furthermore, although it has been described with reference to a three-pole circuit breaker construction, it will naturally be understood that the invention can be applied to single-pole breakers. Other variations are possible.

We claim:

1. In an electric overload protection apparatus including a thermal element which on being heated by fault current is deflected towards a pivotable trip bar for tripping a circuit breaker, the improvement in a means for varying the action of the thermal element and thereby varying the rating of the circuit breaker comprising:

a slide displaceable relative to the thermal element, a camming element pivotable in response to movement of the slide, a manually operable externally accessible knob having a recess, a rotatable boss eccentrically and adjustably mounted in the recess of the knob, with rotation of the knob achieving corresponding linear displacement of the slide in a plane substantially parallel to the thermal element.

2. In the electric overload protection apparatus of claim 1, with the amount of deflection of the thermal element for causing a tripping of the trip bar being variable according to the camming action of the camming element as determined by the position of the slide.

3. In the apparatus of claim 1, with one of the boss and knob being formed with a groove and the other of the boss and knob being formed with a complementary rib engageable in the groove, and with the rib and groove extending diametrically relative to the axis of rotation of the knob and providing for a corresponding diametrical adjustment of the boss.

4. In the apparatus as claimed in claim 1, with the slide being recessed to define spaced opposite bearing surfaces and with the slide being engageable with the boss by the locating of the slide between the bearing surfaces of the recess.

5. In the apparatus as claimed in claim 1, with the eccentricity of the boss being adjustable for varying the magnitude of the variation of the action of the thermal element and of the rating.

6. In the electric overload protection apparatus as claimed in claim 4 with the slide having a pair of transverse thrust ribs and the boss being positioned between the thrust ribs.

* * * * *